US009085088B2

(12) United States Patent
Yagi et al.

(10) Patent No.: US 9,085,088 B2
(45) Date of Patent: Jul. 21, 2015

(54) STAPLER

(75) Inventors: Nobuaki Yagi, Tokyo (JP); Futoshi Kameda, Tokyo (JP)

(73) Assignee: MAX CO., LTD., Chuo-ku, Tokyo (JP)

( * ) Notice: Subject to any disclaimer, the term of this patent is extended or adjusted under 35 U.S.C. 154(b) by 435 days.

(21) Appl. No.: 13/562,682

(22) Filed: Jul. 31, 2012

(65) Prior Publication Data

US 2013/0032624 A1 Feb. 7, 2013

(30) Foreign Application Priority Data

Aug. 1, 2011 (JP) ..... 2011-168275

(51) Int. Cl.
*B25C 5/02* (2006.01)
*B27F 7/19* (2006.01)

(52) U.S. Cl.
CPC ..... *B27F 7/19* (2013.01); *B25C 5/0207* (2013.01)

(58) Field of Classification Search
CPC ..... B25C 1/00; B25C 5/02; B25F 7/19
USPC ..... 227/79, 131, 152, 153, 155
See application file for complete search history.

(56) References Cited

U.S. PATENT DOCUMENTS

| | | | | |
|---|---|---|---|---|
| 3,282,489 | A * | 11/1966 | March | 227/7 |
| 5,029,745 | A * | 7/1991 | Akizawa et al. | 227/155 |
| 6,056,183 | A * | 5/2000 | Tanabe | 227/155 |
| 6,371,352 | B1 * | 4/2002 | Mochizuki | 227/155 |
| 6,484,921 | B2 * | 11/2002 | Hakozaki et al. | 227/2 |
| 7,108,165 | B2 * | 9/2006 | Tsai | 227/155 |
| 7,111,378 | B2 * | 9/2006 | Aldana | 29/525.05 |
| 7,159,749 | B2 * | 1/2007 | Tsai | 227/155 |
| 7,228,999 | B2 * | 6/2007 | Oide et al. | 227/155 |
| 7,311,236 | B2 * | 12/2007 | Smith et al. | 227/131 |
| 7,828,182 | B2 * | 11/2010 | Lin et al. | 227/64 |
| 7,938,306 | B2 * | 5/2011 | Sugihara et al. | 227/155 |
| 8,365,970 | B2 * | 2/2013 | Matsui et al. | 227/6 |
| 2006/0273134 | A1 | 12/2006 | Smith et al. | |
| 2009/0159636 | A1 | 6/2009 | Shen | |

FOREIGN PATENT DOCUMENTS

| | | | |
|---|---|---|---|
| CN | 201120784 | Y | 9/2008 |
| CN | 102019784 | A | 4/2011 |
| EP | 1 736 282 | A1 | 12/2006 |
| JP | 2003-311646 | | 11/2003 |
| JP | 2003-311647 | | 11/2003 |
| JP | 2004-230482 | | 8/2004 |
| WO | WO 03/090975 | A1 | 11/2003 |
| WO | WO 2009/005100 | A1 | 1/2009 |

* cited by examiner

*Primary Examiner* — Scott A. Smith
(74) *Attorney, Agent, or Firm* — Drinker Biddle & Reath LLP

(57) ABSTRACT

A stapler includes a driver mechanism and a clincher mechanism. The clincher mechanism includes a base, a clincher resiliently supported on the base such that the clincher is biased toward the driver mechanism, and a clincher guide having a guide portion configured to guide a movement of the clincher. The guide portion has an inner peripheral surface that forms a through hole extending through the clincher guide and surrounds an outer periphery of the clincher. The inner peripheral surface has recessed surface portions extending from a surface of the clincher guide facing the driver mechanism, such that a gap is provided between the clincher and the recessed surface portions. The recessed surface portions are formed at locations corresponding to portions of the clincher where distal ends of the leg portions of the staple hit.

7 Claims, 7 Drawing Sheets

STAPLER

CROSS-REFERENCE TO RELATED APPLICATION(S)

The present application claims the benefit of priority of Japanese Patent Application No. 2011-168275, filed on Aug. 1, 2011, the disclosure of which is incorporated herein by reference.

TECHNICAL FIELD

The present invention relates to a stapler having a driver mechanism configured to drive a staple through sheets of paper, and a clincher mechanism configured to bend leg portions of the staple penetrating through the paper sheets to bind the paper sheets.

BACKGROUND

A related art stapler has a driver mechanism configured to drive a staple through sheets of paper, and a clincher mechanism configured to bend leg portions of the staple penetrating through the paper sheets to bind the paper sheets (see, e.g., JP2003-311646A, JP2003-311647A and JP2004-230482A). The clincher mechanism includes, for example, a clincher configured to engage with the leg portions of the staple to bend the leg portions, and a clincher guide having a guide portion configured to guide the clincher. The clincher is provided in the base so as to be movable relative to the base in a direction towards and away from the driver mechanism. The guide portion guides the clincher when the clincher is moving. The clincher is configured to allow, when bending the leg portions of the staple, a certain degree of deviation from the position at which the staple is stuck by the driver mechanism. A gap between the guide portion and the clincher is reduced to be minimum limit so as to prevent foreign objects, such as dust, from entering inside the clincher mechanism.

However, when for example a staple is struck by the driver mechanism in a state in which the staple is not held in a regular position due to jamming or the like, or when binding hard papers or more than a prescribed number of sheets of paper, the leg portions of the staple may deviate beyond the allowable range, in which case the leg portions fail to hit the clincher and enter the gap between the clincher and the guide portion such that the leg portions are stuck in the gap. In such a case, not only that it results in a stapling failure, but also it is difficult to remove the staple from the clincher mechanism. For example, in a case in which the driver mechanism is an electrical type, due to a large driving power, the staple is tightly caught in the gap. As a consequence, an attempt to pull out the paper sheets merely results in tearing the paper sheets, and the staple remains in the clincher mechanism. In particular, when the electric stapler is installed in an apparatus, such as copiers and printers, it is not easy to access a binding entrance from which the paper sheets are inserted between the driver mechanism and the clincher mechanism. Thus, it is extremely onerous to remove the staple from the clincher mechanism.

SUMMARY

Illustrative aspects of the present invention provide a stapler in which a staple is easily removable from a clincher mechanism when leg portions of a staple driven by a driver mechanism fail to hit a clincher.

According to an illustrative aspect of the present invention, a stapler includes a driver mechanism configured to drive a staple into paper sheets, and a clincher mechanism configured to bend leg portions of the staple penetrating through the paper sheets to bind the paper sheets. The clincher mechanism includes a base, a clincher resiliently supported on the base such that the clincher is biased toward the driver mechanism, the clincher being arranged to move toward the base when pressed by the leg portions of the staple and configured to bend the leg portions, and a clincher guide having a guide portion configured to guide a movement of the clincher, the clincher guide being arranged to move relative to the base between an upper position at which the clincher guide supports the paper sheets and a lower position at which the leg portions of the staple are caused to engage with the clincher. The guide portion has an inner peripheral surface that forms a through hole extending through the clincher guide and surrounds an outer periphery of the clincher. The inner peripheral surface has recessed surface portions extending from a surface of the clincher guide facing the driver mechanism, such that a gap is provided between the clincher and the recessed surface portions. The recessed surface portions are formed at locations corresponding to portions of the clincher where distal ends of the leg portions of the staple hit.

Other aspects and advantages of the present invention will be apparent from the following description, the drawings, and the claims.

DETAILED DESCRIPTION

Hereinafter, an embodiment of the present invention will be described with reference to the drawings in the following order.

1. Overall Configuration of Stapler
2. Driver Mechanism
3. Clincher Mechanism
3-1. Base
3-2. Clincher
3-3. Clincher Guide
3-4. Slider
4. Operation of Stapler
5. Modifications 1. Overall Configuration of Stapler A stapler 1 according to an embodiment of the present invention is, for example, an electric stapler adapted to be installed along a feeding path of paper sheets inside an apparatus, such as copiers and printers. The electric stapler is driven by a drive motor to bind the sheets of printed papers or copies.

Figure 1:
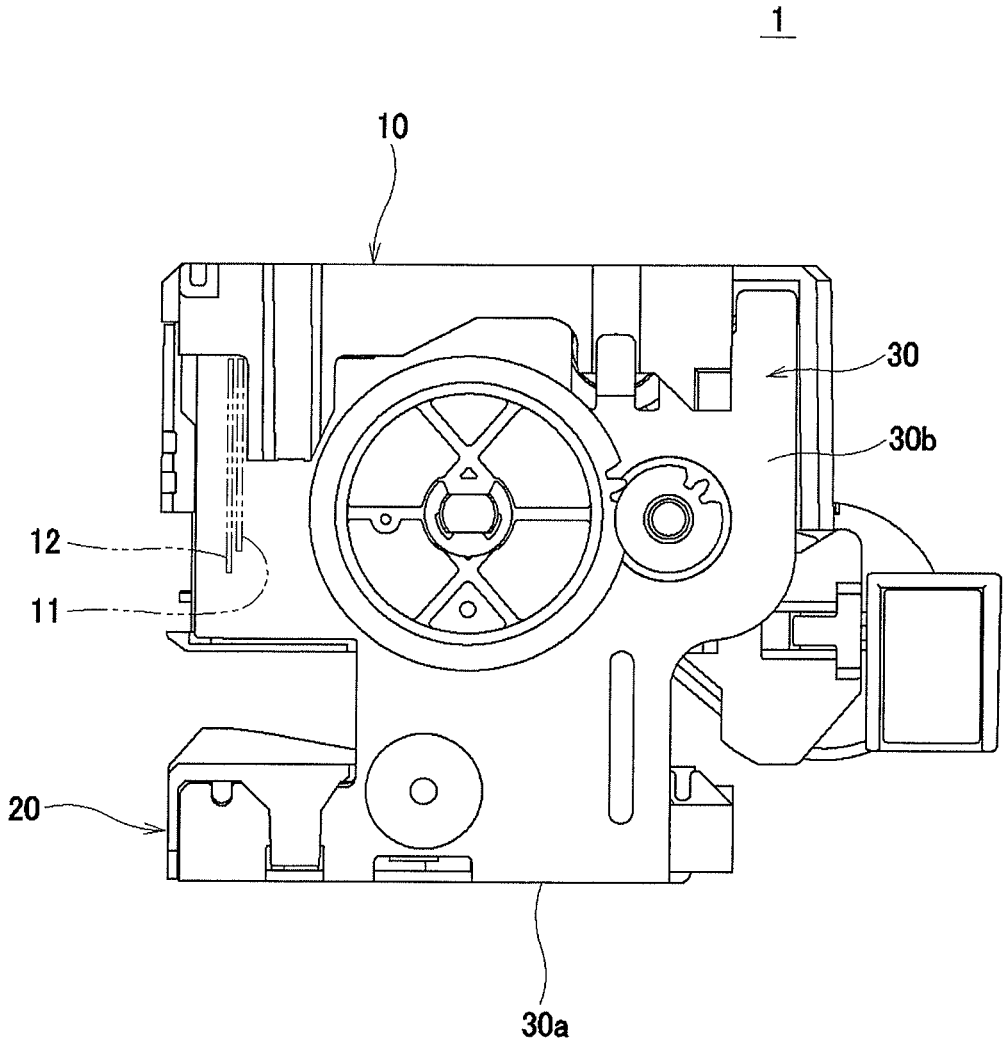
FIG. 1 is a side view of a stapler according to an embodiment of the present invention.

As shown in FIG. 1, the stapler 1 includes a driver mechanism 10 configured to strike staples loaded therein into the paper sheets, a clincher mechanism 20 configured to bend leg portions of the staple penetrating through the paper sheets to bind the paper sheets, and a U-shaped frame 30. The clincher mechanism 20 is placed and fixed on a bottom wall 30*a* of the frame 30. A gap forming a binding entrance is provided between a striking portion of the driver mechanism 10 and the clincher mechanism 20. The driver mechanism 10 is attached to distal ends of a pair of side walls 30*b* of the frame 30 so as to be moveable in a direction (e.g., a vertical direction) toward and away from the clincher mechanism 20.

2. Driver Mechanism

The driver mechanism 10 is configured such that a cartridge loaded with the refill is placed in a magazine of stapler 1. The refill accommodates a stack of staple sheets or a rolled staple sheet. The staple sheet is formed of a plurality of straight staples that are arranged in parallel and connected. The driver mechanism 10 sends the staples in the cartridge one by one to the striking portion, and forms a pair of leg portions by bending the staple using a forming plate 11. Thereafter, the driver mechanism 10 drives the staple using the driver plate 12 along a striking passage inside the driver mechanism 10 and into the paper sheets placed on the clincher mechanism 20. The forming plate 11 and the driver plate 12 are driven by the drive motor via a transmission mechanism, such as gears, a link mechanism, etc.

3. Clincher Mechanism

As shown in FIGS. 2 to 6, the clincher mechanism 20 has a clincher 22 resiliently supported on the base 21, a clincher guide 24 arranged to move relative to the base 21, and a slider 25 provided in the base 21 and arranged to slide relative to the base 21. The clincher 22 is configured to engage with the leg portions of the staple to bend the leg portions that have been driven by the driver mechanism 10 and passed through the paper sheets. The clincher guide 24 has a guide portion 23 configured to guide the clincher 22 when the clincher 22 moves.

3-1. Base

Figure 3:
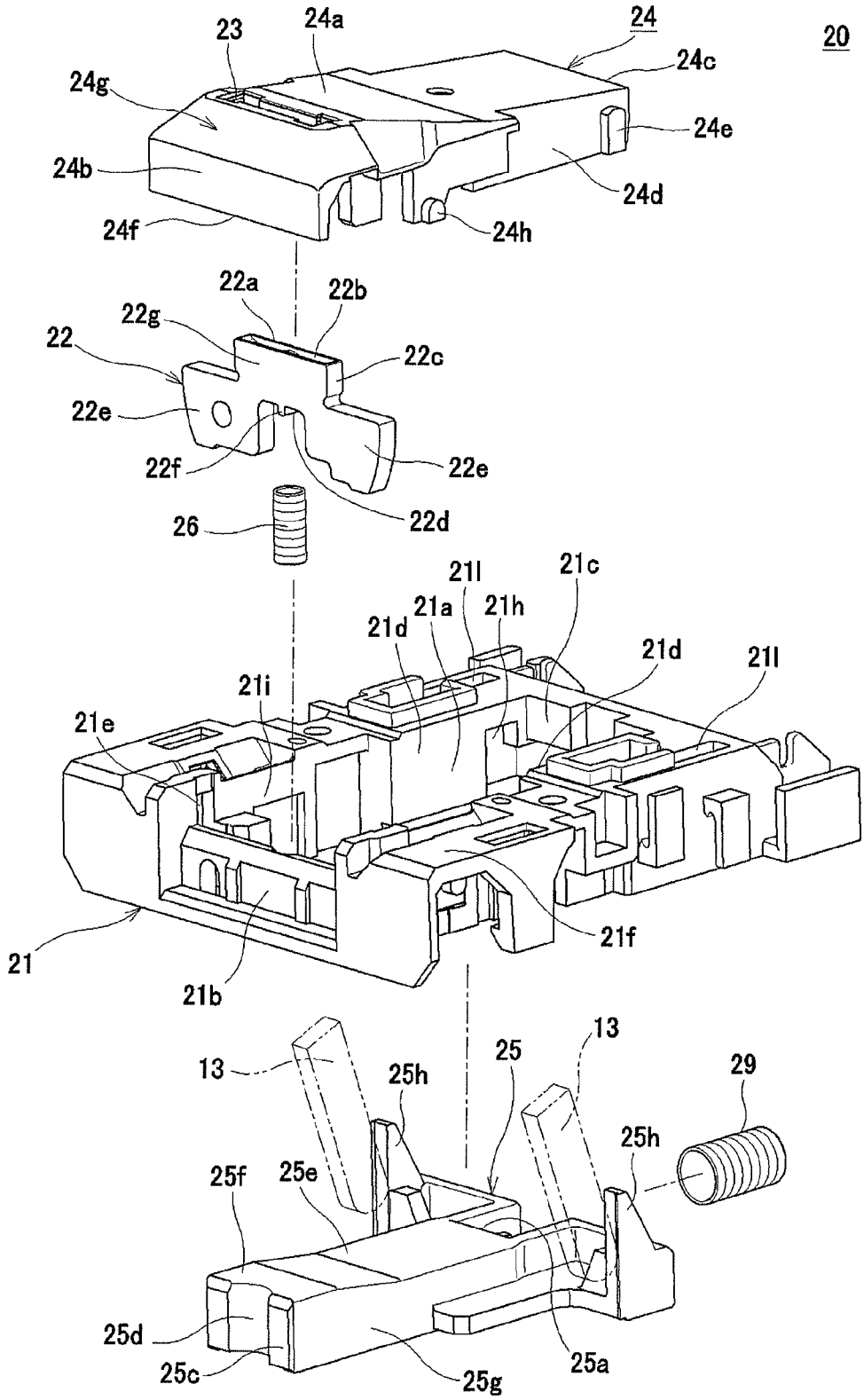
FIG. 3 is an exploded perspective view of the clincher mechanism.

As shown in FIG. 3, the base 21 has a rectangular shape. A rectangular opening portion 21*a* is formed in a central portion of the base 21 when observed in a plan view to accommodate the clincher guide 24 and the slider 25. Hereinafter, a direction in which the front wall 21*b* and the rear wall 21*c* of the opening portion 21*a* of the base 21 face each other is referred to as a front-rear direction, and a direction in which the side walls 21*d* of the opening portion 21*a* face each other is referred to as a width direction.

Figure 4:
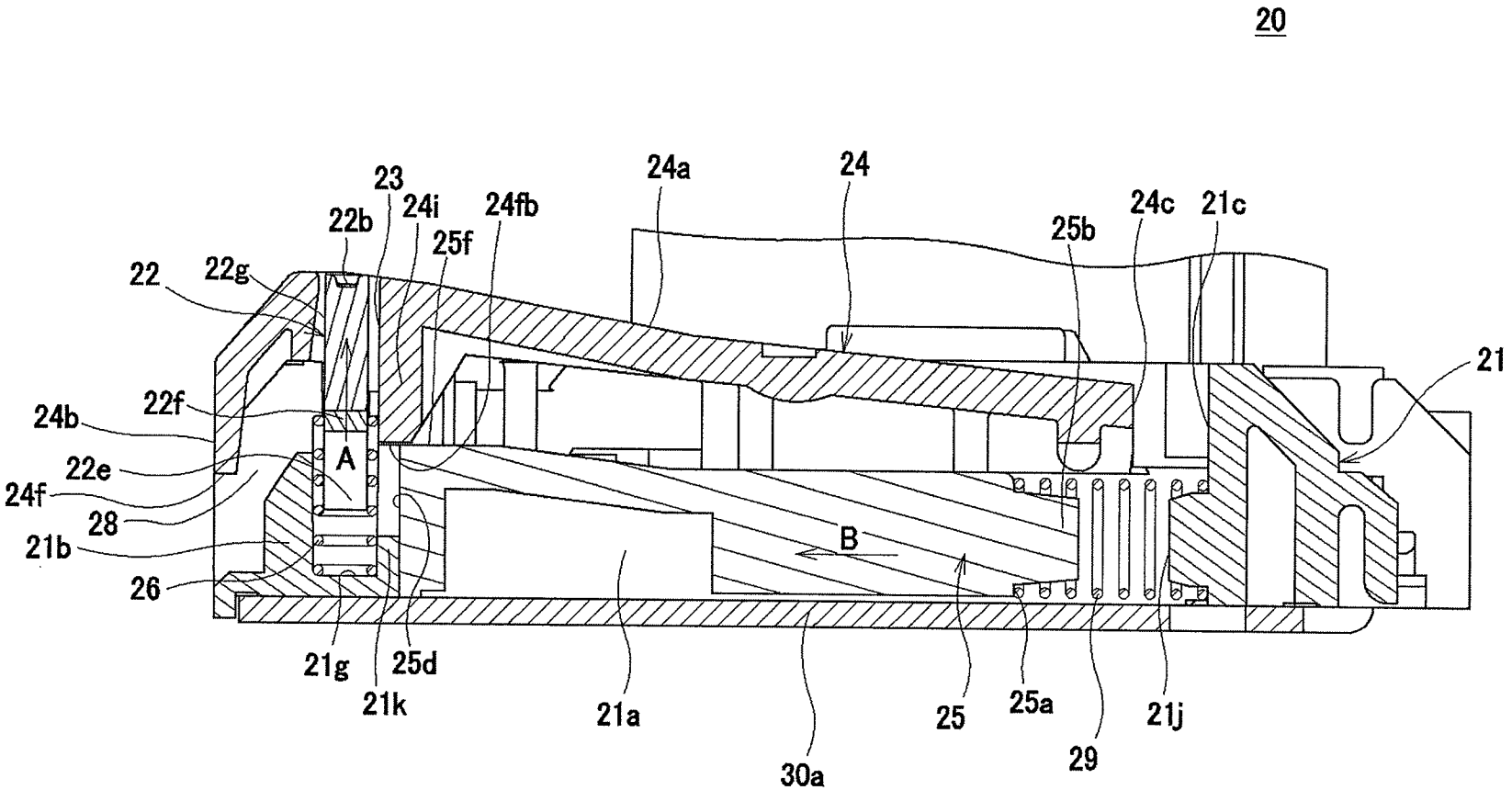
FIG. 4 is a longitudinal cross-sectional view of the clincher mechanism, illustrating a state in which the clincher is in an upper position.

As shown in FIG. 4, the clincher mechanism 20 is attached on the bottom wall 30*a* of the frame 30, whereby the opening portion 21*a* of the base 21 is closed by the bottom wall 30*a* of the frame 30. The opening portion 21*a* of the base 21 may be closed by a different member instead of the bottom wall 30*a* of the frame 30.

3-2. Clincher

As shown in FIG. 3, a concave clincher groove 22*b* is formed on the upper face 22*a* of the clincher 22. The clincher groove 22*b* is configured to engage with the leg portions of the staple struck by the driver mechanism 10, and to guide the leg portions such that the leg portions are inwardly bent in a substantially flat manner along the back surface of the paper sheets.

The clincher 22 has bulged portions 22*e* formed below the side faces 22*c* of the clincher 22 in a laterally extending manner (bulged in the width direction). The bulged portions 22*e* are received in the vertically extending guide grooves 21*e* in the front portions of the side walls 21*d* of the base 21. Accordingly, the clincher 22 is vertically movable relative to the base 21 in a direction toward and away from the driver mechanism 10.

A downwardly extending protrusion 22*f* is formed on the lower face 22*d* of the clincher 22. As shown in FIG. 4, a biasing member 26, e.g., a spring, engages with the protrusion 22*f*. The biasing member 26 has one end received in a receiving portion 21*g*, which is formed in the front wall 21*b* of the base 21, and the other end engaged with the protrusion 22*f* of the clincher 22. In this manner, the clincher 22 is resiliently supported on the base 21, and is upwardly biased toward the driver mechanism 10 in the direction A shown in FIG. 4. The upper position of the clincher 22 is defined by the engagement of the bulged portions 22*e* to the clincher guide 24. The clincher 22 is provided such that the upper end portion 22*g* is accommodated in the guide portion 23 of the clincher guide 24 and such that the clincher groove 22*b* is substantially flush with the upper surface of the upper wall 24*a* of the clincher guide 24.

3-3. Clincher Guide

As shown in FIG. 3, the clincher guide 24 also has a rectangular shape. The clincher guide 24 is accommodated in the opening portion 21*a* of the base 21 such that the front wall 21*b* faces the front wall 21*b* of the base 21 and the rear wall 24*c* faces the rear wall 21*c* of the base 21. A protrusion 24*e* is formed on the rear portion of each of the side wall 24*d* of the clincher guide 24 to laterally protrude in the width direction. The protrusion 24*e* is engaged with a concave portion 21*h* formed in the rear portion of the corresponding side wall 21*d* of the base 21, whereby the clincher guide 24 is supported so as to be vertically movable relative to the base 21. That is, the clincher guide 24 is movable to the upper position toward the drive mechanism 10 and to the lower position away from the drive mechanism 10.

The upwardly biased bulged portions 22*e* of the clincher 22 are engaged with the bottom face 24*f* of the clincher guide 24. In this manner, the front end portion 24*g* of the clincher guide 24 is biased upward by the biasing member 26 via the clincher 22. A protrusion 24*h* is formed on the front portion of each of the side walls 24*d* to laterally protrude therefrom. The protrusion 24*h* engages with a stopper portion 21*i* formed in the front portion of the corresponding side wall 21*d* of the opening portion 21*a*, whereby the upper position of the front end portion 24*g* of the clincher guide 24 is defined.

Figure 5:
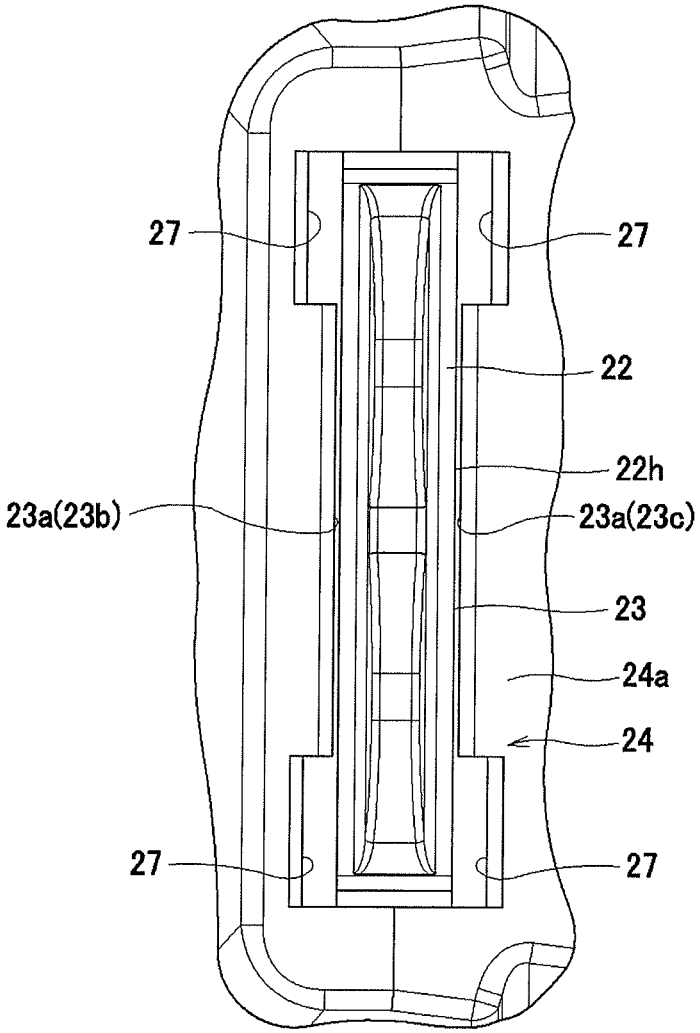
FIG. 5 is a plan view of a guide portion of a clincher guide.

As shown in FIG. 5, a guide portion 23 is formed in the front portion of the upper wall 24*a* of the clincher guide 24. The guide portion 23 is configured to accommodate the clincher 22 and to guide the clincher 22 when the clincher 22 moves vertically. The guide portion 23 has an inner peripheral surface 23*a* forming a through hole extending through the upper wall 24*a* of the clincher guide 24. The inner peripheral surface 23*a* of the guide portion 23 surrounds the outer periphery 22*h* of the clincher 22 such that a gap is provided between the inner peripheral surface 23*a* and the outer peripheral 22*h* of the clincher 22.

More specifically, the guide portion 23 is formed in a rectangular shape that corresponds to the cross-sectional shape of the upper end portion 22*g* of the clincher 22. The gap between the inner peripheral surface 23*a* of the guide portion 23 and the outer periphery 22*h* of the clincher 22 is, for example, about 0.1 mm, so that foreign matters, such as dust, are prevented from entering the clincher mechanism 20 from the gap between the inner peripheral surface 23*a* of the guide portion 23 and the outer periphery 22*h* of the clincher 22.

The gap between the inner peripheral surface 23*a* of the guide portion 23 and the outer periphery 22*h* of the clincher 22 is not limited to about 0.1 mm, in so far as the gap is smaller than the minimum dimension of the cross-section of the wire of the forming the staple adapted for use in the stapler 1, except where recessed surface portions 27 are provided.

The inner peripheral surface 23*a* of the guide portion 23 has the recessed surface portions 27. The recessed surface portions 27 are formed, for example, at locations on the inner peripheral surface 23*a* of the guide portion 23 corresponding to the portions of the clincher 22 where the distal ends of the leg portions of the staple are supposed to hit. The lengths of each of the recessed surface portions 27 in the front-rear direction and in the width direction are both greater than the maximum dimension of the cross-section of the wire forming the staple adapted for use in the stapler 1.

Specifically, each of the recessed surface portion 27 has a rectangular shape when observed in a plan view, and forms a through hole extending through the upper wall 24*a* of the clincher guide 24 as a part of the inner peripheral surface 23*a* of the guide portion 23. The recessed surface portions 27 are formed on each side of the inner peripheral surface 23*a* of the guide portion 23 in the width direction, on the front portion 23*b* and the rear portion 23*c* of the inner peripheral surface 23*a*. That is, there are four recessed surface portions 27 in total.

Accordingly, when for example the staple is struck by the driver mechanism 10 in a state in which the staple is not held in the regular position due to jamming or the like, and a stapling failure occurs due to the leg portions of the staple failing to hit the clincher groove 22*b* of the clincher 22, the leg portions of the staple are inserted between the clincher 22 and the recessed surface portions 27 in a removable manner. Therefore, it is possible to prevent a situation where the leg portions are stuck in the gap between the clincher 22 and the clincher guide 24. The leg portions that have failed to hit the clincher 22 are inserted between the clincher 22 and the recessed surface portions 27 in the state in which, for example, the leg portions are penetrating through the paper sheets. In such as case, the staple can be easily removed from the clincher mechanism 20 by simply pulling the paper sheets.

Further, because the recessed surface portions 27 forms the through hole extending through the upper wall 24*a* of the clincher guide 24, as shown in FIG. 4, the recessed surface portions 20 communicate with the outside of the clincher mechanism 21*a* through the space 28 between the front wall 21*b* of the opening portion 21*a* of the base 21 and the front wall 24*b* of the clincher guide 24. Accordingly, when for example the staple that has failed to hit the clincher 22 breaks during the binding operation and a separated leg portion of the staple enters into the clincher mechanism 20 from a gap between the clincher 22 and the recessed surface portion 27, it is possible to discharge the leg portion to the outside of the clincher mechanism 20 through the space 28.

A storage portion may be additionally provided to collect the staples or the like discharged to the outside of the clincher mechanism 20 through the space 28. Further, instead of or in addition to the space 28, an opening may be provided in the front portion of the bottom wall 30*a* of the frame 30, so that the staple or the like entered inside the clincher mechanism 20 is discharged to the outside of the clincher mechanism 20 through the opening.

The recessed surface portions 27 may be formed only in the front portion 23*b* of the inner peripheral surface 23*a* of the guide portion 23 or only in the rear portion 23*c* of the inner peripheral surface 23*a*. The recessed surface portions 27 may be formed near the end portions in the width direction of the front portion 23*b* and the rear portion 23*c*, in so far as they are formed around the portions of the clincher 22 where the distal ends of the leg portions of the staple are supposed to hit. The recessed surface portions 27 may be formed in other shapes, such as a semicircular shape, an circular arc shape, an oval shape, a U shape, a triangular shape and a polygonal shape, in so far as the gap between the clincher 22 and the recessed surface portions 27 is wider than the maximum dimension of the cross-section of the wire forming the staple.

3-4. Slider

As shown in FIG. 4, the slider 25 is provided below the clincher guide 24, that is, between the clincher guide 24 and the bottom wall 30*a* of the frame 30, in a slidable manner in the front-rear direction. The rear face 25*a* of the slider 25 is formed with a rearwardly extending protrusion 25*b*. A biasing member 29, e.g., a spring, is engaged with the protrusion 25*b*. The biasing member 29 has one end engaged with a protrusion 21*j* on the rear wall 21*c* of the base 21, and the other end engaged with the protrusion 25*b* of the slider 25. In this manner, the slider 25 is biased forward in the direction B shown in FIG. 4.

As shown in FIG. 3, the front face 25*c* of the slider 25 is formed with a contact portion 25*d*. As shown in FIG. 4, when the slider 25 is moved forward by the biasing member 26, the contact portion 25*d* contacts a restraining portion 21*k* of the front wall 21*b* of the base 21, whereby the front position of the slider 25 is defined.

As shown in FIG. 3, the front portion of the upper surface 25*e* of the slider 25 is formed with a support portion 25*f*. As shown in FIG. 4, when the slider 25 is in the front position, the support portion 25*f* enters the space below the bottom face 24*fb* of the clincher guide 24 and engages with the support portion 24*i* on the inner surface of the upper wall 24*a* of the clincher guide 24. In this manner, the slider 25 prevents the downward movement of the clincher guide 24. That is, the slider 25 holds the clincher guide 24 in the upper position with respect to the base 21 when placed in the front position.

Figure 2:
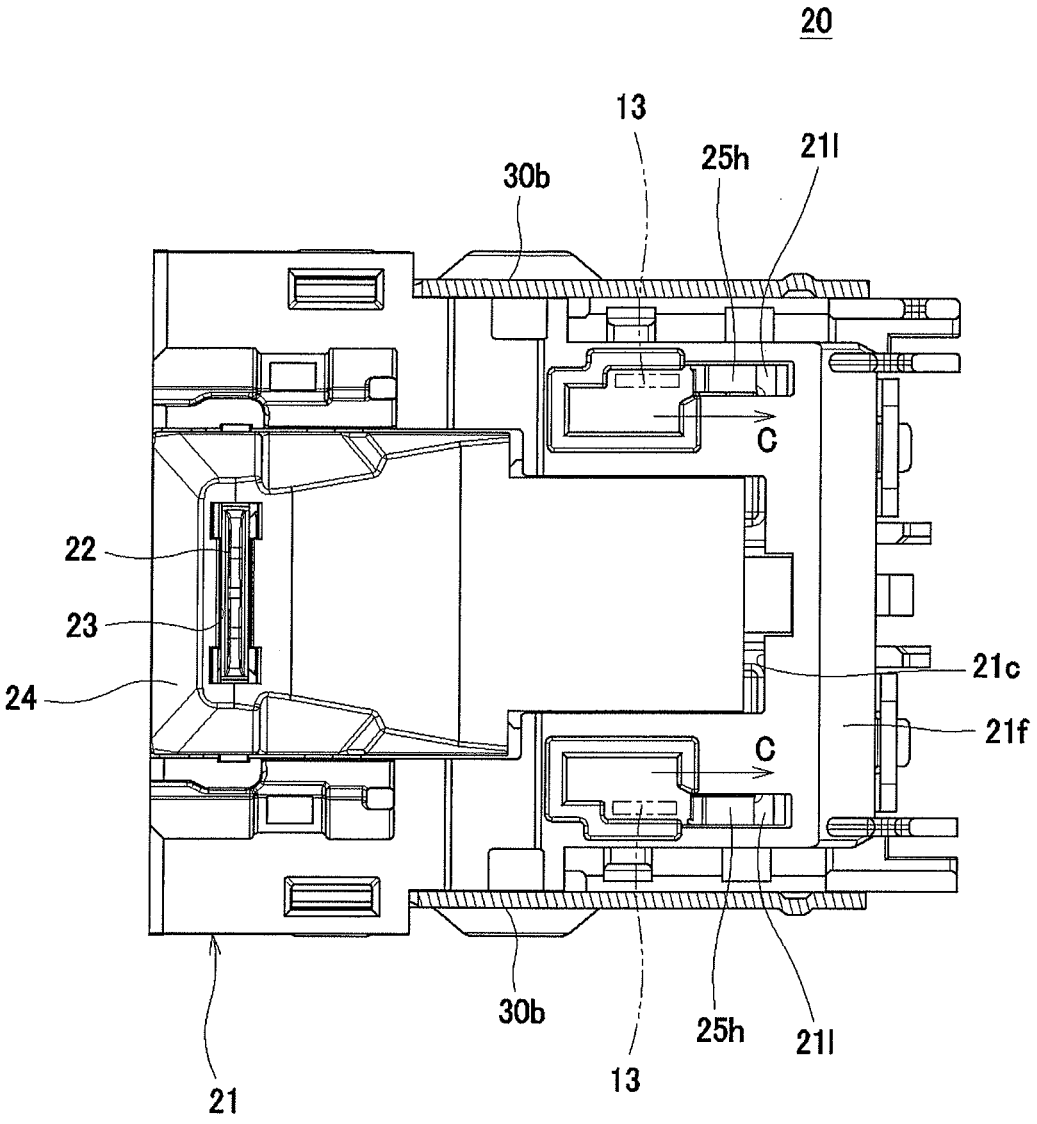
FIG. 2 is a plan view of a clincher mechanism of the stapler.
Figure 6:
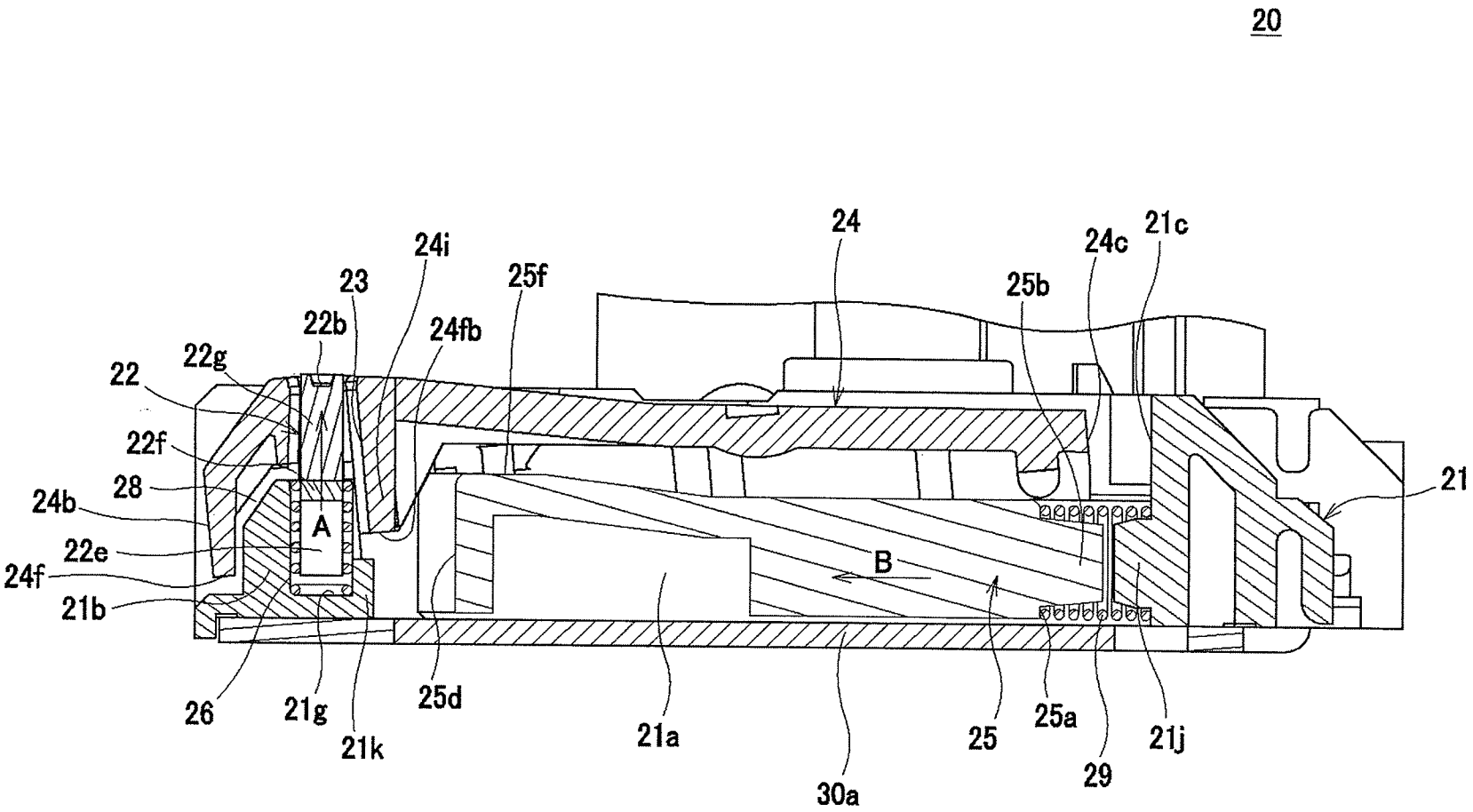
FIG. 6 is a longitudinal cross-sectional view of the clincher mechanism, illustrating a state in which the clincher is in a lower position.

As shown in FIG. 3, a projection 25*h* is formed on the rear portion of each of the side surfaces 25*g* of the slider 25. The projection 25*h* is engaged with a corresponding unlocking member 13 provided in the driver mechanism 10. As shown in FIG. 2, when the driver mechanism 10 strikes the staple, the projections 25*h* are pushed rearward in the direction C by the unlocking members 13. As a result, as shown in FIG. 6, the slider 25 is moved rearward against biasing force of the biasing member 29, and the support portion 25*f* is separated from the support portion 24*i* of the clincher guide 24 so that the engagement with the support portion 24*i* is released, thereby allowing the front end portion 24*g* of the clincher guide 24 move to the lower position. Furthermore, as shown in FIG. 2, distal end portions of the projections 25*h* are received in the guide grooves 21*l* formed in the rear portion of the base 21. Each of the guide groove 21*l* is opened at the upper surface 21*f* and is formed along the front-rear direction. Accordingly, the slider 25 can smoothly move in the front-rear direction.

That is, the slider 25 is slidable between the front position in which the support portion 25*f* engages with the support portion 24*i* of the clincher guide 24 to hold the clincher guide 24 in the upper position, and the rear position in which the engagement of the support position 25*f* with the support portion 24*i* of the clincher guide 24 is released to allow the front end portion 24*g* of the clincher guide 24 to move to the lower position.

4. Operation of Stapler

Next, an operation of binding the paper sheets by the stapler 1 will be described.

Figure 7:
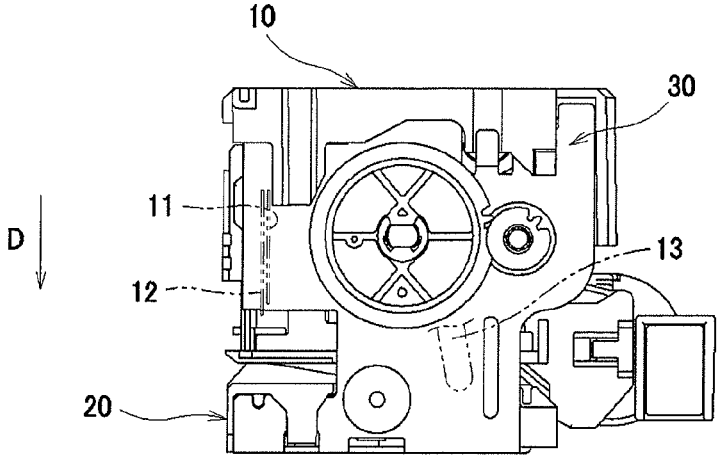
FIG. 7 is a side view of the stapler, illustrating a state in which sheets of papers are clamped between the driver mechanism and the clincher guide.

Firstly, the paper sheets are inserted into the binding entrance between the driver mechanism 10 and the upper wall 24*a* of the clincher guide 24 along the front-rear direction by being fed along a feeding path inside the apparatus. Then, as shown in FIG. 7, the driver mechanism 10 moves downward in the direction D by being driven by the drive motor via a transmission mechanism, and clamps the paper sheets between the driver mechanism 10 and the clincher guide 24. At this point, as shown in FIG. 4, the slider 25 is biased by the biasing member 29 and is placed in the front position, and the support portion 25*f* is engaged with the support portion 24*i* of the clincher guide 24 to hold the clincher guide 24 in the upper position. Thus, the clincher guide 24 supports the paper sheets at its upper position. Further, the clincher 22 is biased upward by the biasing member 26 such that the clincher groove 22*b* is substantially flush with the upper surface of the upper wall 24*a* of the clincher guide 24.

Figure 8:
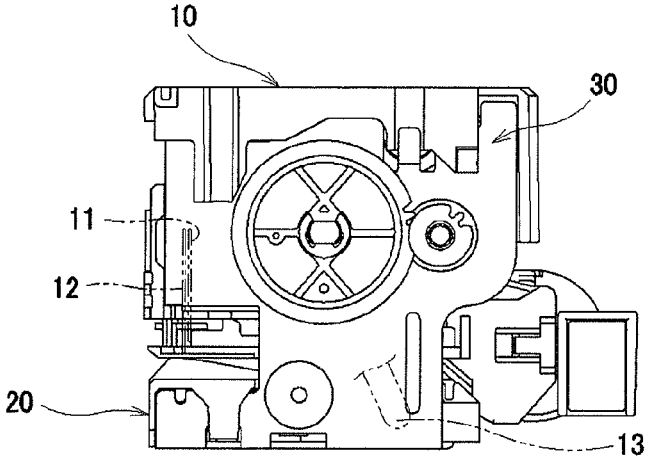
FIG. 8 is another side view of the stapler, illustrating a state in which a driver plate of the driver mechanism has struck the staple into the paper sheets.

Next, as shown in FIG. 8, the driver plate 12 of the driver mechanism 10 is driven by the drive motor via a transmission mechanism to strike the staple inside the driver mechanism 10 toward the paper sheets. The leg portions of the struck staple penetrate through the paper sheets and hit the clincher groove 22*b* of the clincher 22, thereby pushing down the clincher 22 against the biasing force of the biasing member 26 to move the clincher 22 downward.

Next, when the staple is driven by the driver plate 12 to a position at which the leg portions of the staple almost entirely penetrate through the paper sheets, as shown in FIG. 2, the unlocking members 13 of the driver mechanism 10 are driven by the drive motor via a transmission mechanism and engage with the projections 25*h* of the slider 25 to move the slider 25 rearward (toward the rear position) in the direction C against the biasing force of the biasing member 29. As a result, as shown in FIG. 6, the engagement between the support portion 25*f* of the slider 25 and the support portion 24*i* of the clincher guide 24 is released, and the clincher guide 24 becomes movable to the lower position.

Figure 9:
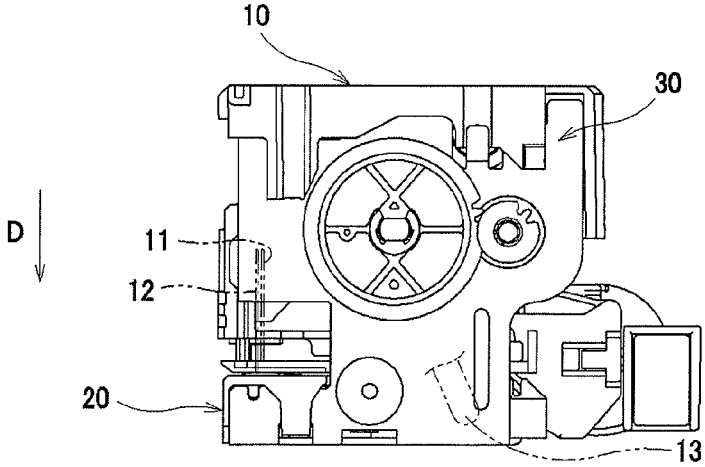
FIG. 9 is another side view of the stapler, illustrating a state in which a clincher groove has bent the leg portions of the staple.

Next, as shown in FIG. 9, along with the further downward movement of the driver mechanism 10 contacting the clincher guide 24, when the clincher guide 24 moves further downward to the lower position, the leg portions of the staple projecting from the back surface of the paper sheets engage with the clincher groove 22*b*, and the clincher groove 22*b* bends the leg portions inward along the back surface of the paper sheets such that the leg portions are formed in a substantially flat manner. Consequently, the paper sheets are bound by the stapler.

During the binding operation of the paper sheets, when for example the staple is driven by the driver mechanism 10 in a state in which the leg portions of the staple are not held in the regular position due to jamming or the like, and the stapling failure occurs due to the leg portions of the staple failing to hit the clincher groove 22*b* of the clincher 22, the leg portions of the staple penetrating through the paper sheets are inserted between the clincher 22 and the recessed surface portions 27 formed around portions of the clincher 22 where the distal ends of the leg portions of the staple are supposed to hit.

The recessed surface portions 27 form the through hole extending through the upper wall 24*a* of the clincher guide 24, and are formed to have a size greater than the maximum dimension of the cross-section of the wire forming the staple. Thus, the leg portions of the staple that have failed to hit the clincher 22 are inserted between the recessed surface portions 27 and the clincher 22 in a removable manner, and is prevented from being stuck between the clincher 22 and the clincher guide 24. Thus, simply pulling the paper sheets for example, the staple can be easily removed from the clincher mechanism 20.

Further, even if the staple that has failed to hit the clincher 22 breaks during the binding operation and, for example, a separated leg portion of the staple enters the gap between the recessed surface portion 27 and the clincher 22 into the clincher mechanism 20, it is possible to discharge the leg portion of the staple to the outside of the clincher mechanism 20 through the space 28 between the front wall 21*b* of the base 21 and the front wall 24*b* of the clincher guide 24.

5. Modifications

The clincher mechanism 20 of the stapler 1 can be applied to an electric stapler that is independently used on the desk, i.e., not installed in an apparatus, such as copiers and printers, and also to a manual type handy stapler that does not include a power drive source, such as a drive motor.

In the case of an electric stapler, while driving the staple into the paper sheets, the paper sheets may move rearward relative to the clincher mechanism 20, so that the leg portions of the staple may deviate rearward relative to the clincher mechanism 20. Thus, the recessed surface portions 27 may be formed only in the rear portion 23*c* of the inner peripheral surface 23*a* of the guide portion 23. In the case of a manual handy stapler, while driving the staple into the paper sheets, the manual handy stapler and the paper sheets may relatively move in a direction separating from each other, i.e., the paper sheets may move forward relative to the clincher mechanism 20, so that the leg portions of the staple may deviate forward relative to the clincher mechanism 20. Thus, the recessed surface portions 27 may be formed only in the front portion 23*b* of the inner peripheral surface 23*a* of the guide portion 23.

What is claimed is:

1. A stapler comprising:

a driver mechanism configured to drive a staple into paper sheets; and a clincher mechanism configured to bend leg portions of the staple penetrating through the paper sheets to bind the paper sheets, wherein the clincher mechanism comprises:

a base;

a clincher resiliently supported on the base such that the clincher is biased toward the driver mechanism, wherein the clincher is arranged to move toward the base when pressed by the leg portions of the staple and configured to bend the leg portions; and a clincher guide comprising a guide portion configured to guide a movement of the clincher, wherein the clincher guide is arranged to move relative to the base between an upper position at which the clincher guide supports the paper sheets and a lower position at which the leg portions of the staple are caused to engage with the clincher, wherein the guide portion comprises an inner peripheral surface forming a through hole extending through the clincher guide and surrounding an outer periphery of the clincher, wherein the inner peripheral surface comprises recessed surface portions extending from a surface of the clincher guide facing the driver mechanism along the entire length of the through hole, such that a gap is provided between the clincher and the recessed surface portions, and wherein the recessed surface portions are formed at locations corresponding to portions of the clincher where distal ends of the leg portions of the staple hit.

2. The stapler according to claim 1, wherein the recessed surface portions are formed in at least one of a front portion and a rear portion of the inner peripheral surface.

3. The stapler according to claim 2, wherein the recessed surface portions are formed in the front portion and the rear portion.

4. The stapler according to claim 1, wherein the clincher mechanism further comprises a slider arranged to slide relative to the base, wherein the slider slides between a front position at which the slider holds the clincher guide in the upper position and a rear position at which the slider allows the clincher guide to move to the lower position.

5. The stapler according to claim 1, wherein the gap between the clincher and the recessed surface portions is greater than a maximum dimension of a cross-section of a wire forming the staple.

6. The stapler according to claim 5, wherein the gap between the clincher and the portion of the inner peripheral surface other than the recessed surface portions is smaller than a minimum dimension of the cross-section of the wire forming the staple.

7. The stapler according to claim 1, wherein the gap between the clincher and the recessed surface portions is wider than a gap between the clincher and a portion of the inner peripheral surface other than the recessed surface portions.

* * * * *